US005502428A

United States Patent [19]

McColloch et al.

[11] Patent Number: 5,502,428

[45] Date of Patent: Mar. 26, 1996

[54] CIRCUIT BREAKER WITH ONE-PIECE CROSSBAR INCLUDING AN INTEGRALLY MOLDED OPERATING ARM

[75] Inventors: Rex J. McColloch, Snellville; Stephen D. Cella, Stone Mountain; Bernard DiMarco, Lilburn, all of Ga.

[73] Assignee: Siemens Energy & Automation Inc., Alpharetta, Ga.

[21] Appl. No.: 413,655

[22] Filed: Mar. 30, 1995

[51] Int. Cl.[6] ..... H01H 9/00

[52] U.S. Cl. ..... 335/172; 335/16

[58] Field of Search ..... 335/167–176, 335/185–190, 8–10, 16, 147, 195

[56] References Cited

U.S. PATENT DOCUMENTS 4,488,133 12/1984 McClellan et al. .
4,611,106 9/1986 Pardini et al. ..... 335/147
4,611,187 9/1986 Banfi ..... 335/16
5,184,099 2/1993 DiMarco et al. ..... 335/195
5,361,051 11/1994 DiMarco et al. ..... 335/16
5,363,076 11/1994 Miller et al. ..... 335/16

*Primary Examiner*—Lincoln Donovan

[57] ABSTRACT

A multi-phase circuit breaker including novel crossbar for opening and closing the circuit breaker contact arms. The crossbar is a one-piece plastic component molded to include an operating arm, insulating barriers for separating the contact arms of each phase, and the cam surfaces which interact with the cam followers of the contact arms. The operating arm is linked to the operating mechanism of the circuit breaker so that operation of the mechanism will pivot the crossbar which pivots the contact arms between their open and closed positions.

20 Claims, 3 Drawing Sheets

CIRCUIT BREAKER WITH ONE-PIECE CROSSBAR INCLUDING AN INTEGRALLY MOLDED OPERATING ARM

FIELD OF THE INVENTION

The present invention relates to the contact operating mechanism of a circuit breaker. In particular, the present invention relates to a new, improved and novel crossbar including an integrally molded operating arm for operably connecting the crossbar to the operating mechanism of the circuit breaker.

BACKGROUND OF THE INVENTION

It is recognized in the prior art that contact operating mechanisms must quickly respond to severe fault conditions by permitting the contact arms and associated contacts to blow open quickly in response to unacceptable fault current conditions. Various mechanical arrangements have been provided to improve blow-open response speeds for the current carrying contacts. For example, circuit breaker designs have produced circuit breaker configurations which provide current paths which utilize the high currents during fault conditions to increase electromagnetic blow-apart forces between contact arms and associated current carrying members in the circuit breaker. Unacceptable fault currents within properly configured current paths produce electrodynamic forces which drive contact arms and associated contacts open quickly. One problem encountered as a result of high blow-apart forces is the potential that these forces cause the contact arm to rebound from its associated stop and bounce back past the over-center position, thereby causing the arm to reengage the circuit breaker contacts.

Another type of circuit breaker design practice used to improve the separation speed and performance of the circuit breaker contacts during unacceptable fault current conditions is the use of cam arrangements with the contact arm. These arrangements produce high contact forces to produce adequate contact engagement pressures during normal operation, and produce reduced or eliminated contact force after the contact arm is moved a relatively small distance during blow-apart under fault current conditions. For example, U.S. Pat. No. 4,488,133, issued to McClellan et al. on Dec. 11, 1984, discloses a current-limiting circuit breaker including a contact pressure spring configured to hold the contact arms and associated contacts in their open position after the contacts are blown open. In particular, a multi-section cam transmits contact opening and closing forces produced by a spring powered, overcenter, toggle-type operating mechanism to the associated pivoting contact arms. A follower on the contact arm is biased into engagement with the cam by the contact pressure spring. The cam is configured so that the moveable contact arm requires relatively little motion to move the knee of the cam surface into the open direction during blow-off under fault conditions. The cam is further configured to control the speed of the contact arm to reduce the potential for contact arm rebound.

While various designs have been provided to increase blow-off speeds and performance of circuit breaker contact arms during unacceptable fault current conditions, the need to reduce circuit breaker size and cost for given voltage and current carrying ratings requires that blow-off speeds and performance increase even though there is substantial market pressure to maintain circuit breaker selling prices. Accordingly, it would be desirable to provide a design which is an improvement over the above-described designs and lower in cost.

SUMMARY OF THE INVENTION

The present invention relates to a one-piece plastic crossbar for a multi-phase circuit breaker of the type including a base, a contact arm associated with each phase and pivotally attached to the base to pivot between open and closed positions to conduct current in the closed position, and an operating mechanism for supplying energy to pivot the contact arms. The crossbar includes first and second plastic contact arm saddles, and a first plastic torque carrying member joined between the saddles and formed integrally with the saddles. The crossbar is pivotably supportable by the base to pivot between a first axis between open and closed positions. The crossbar further includes a plastic operating arm joined to the crossbar between the saddles, the plastic operating arm being formed integrally with the saddles and the torque carrying member. The operating arm includes a linking end offset from the first axis and connectable with the operating mechanism to pivot the crossbar to its open position while the saddles engage the contact arms to thereby move the contact arms to their open positions.

The present invention further relates to a multi-phase circuit breaker. The circuit breaker contact operating mechanism supported by a support frame, first and second contact arms supported by the frame to pivot between open and closed positions about a first axis, and a one-piece plastic crossbar. The crossbar is supported by the frame to pivot between open and closed positions about a second axis substantially parallel to the first axis, and includes a plastic operating arm integrally formed with the crossbar, extending from the crossbar and including a link end offset from the second axis. The link end is mechanically connected to the operating mechanism. First and second clutches couple the crossbar to the first and second contact arms, respectively, such that the contact arms move to their open positions when the crossbar is moved to its open position, and the contact arms are permitted to independently move to their open positions while the crossbar is in its closed position.

In the case of large multipole circuit breakers, the contact forces on the outer poles act to twist the crossbar due to elastic properties of the material. This results in lower contact forces. This effect is more critical on circuit breakers with higher ratings where the contact force is much higher. A method used to compensate for crossbar twisting is described in U.S. Pat. No. 4,488,133. The '133 device includes different cams or springs for the outer poles. This arrangement presents problems during production due to the dissimilar pole configurations. With the new design, the single piece molded crossbar can incorporate an offset to compensate for any twisting in the shaft. Thus all components of the outer pole contact structures are the same as the center pole.

DETAILED DESCRIPTION OF THE PREFERRED EMBODIMENT

Figure 1:
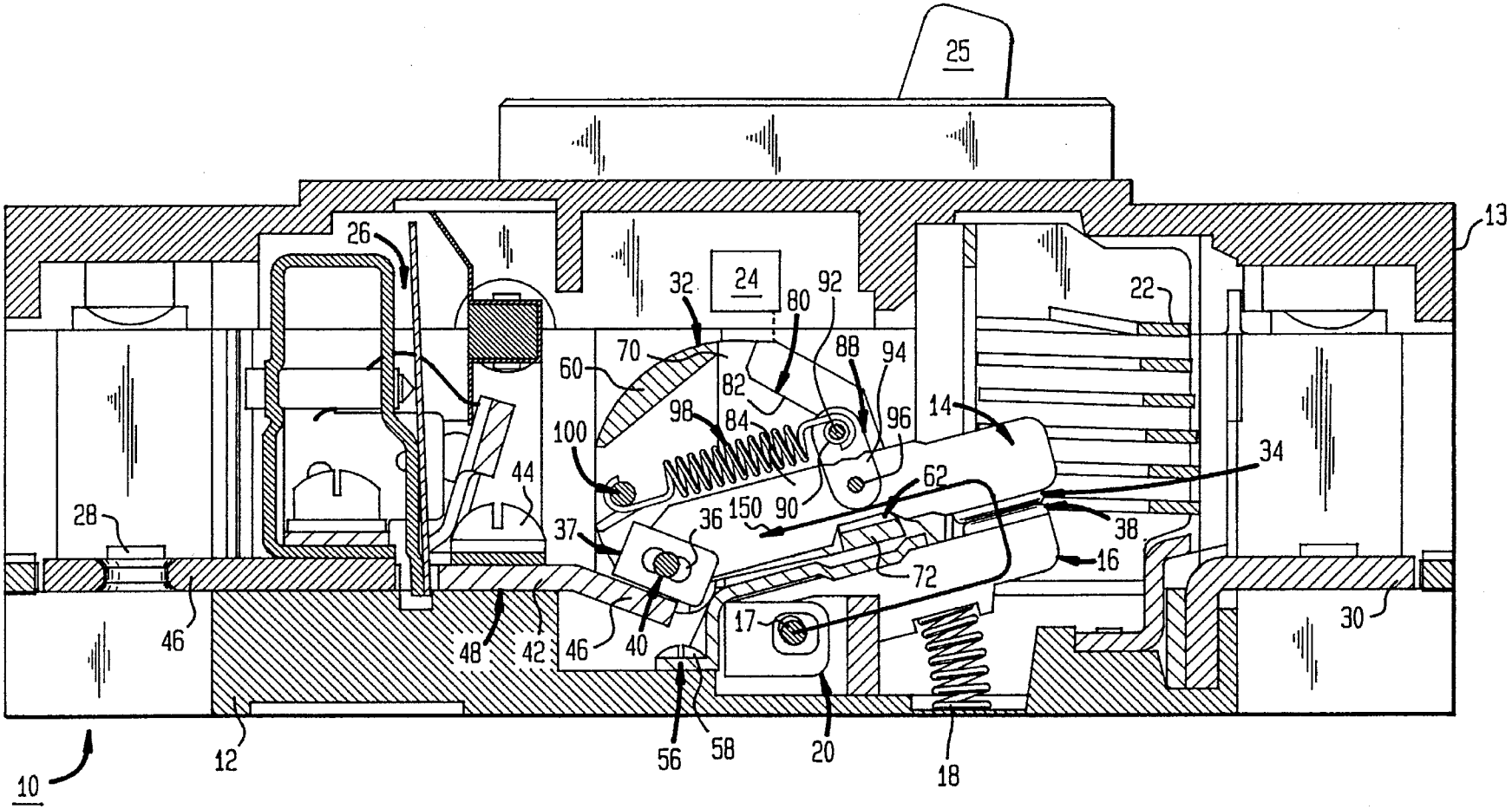
FIG. 1 is a sectional view of a circuit breaker taken along line 2—2 of FIG. 2.
Figure 2:
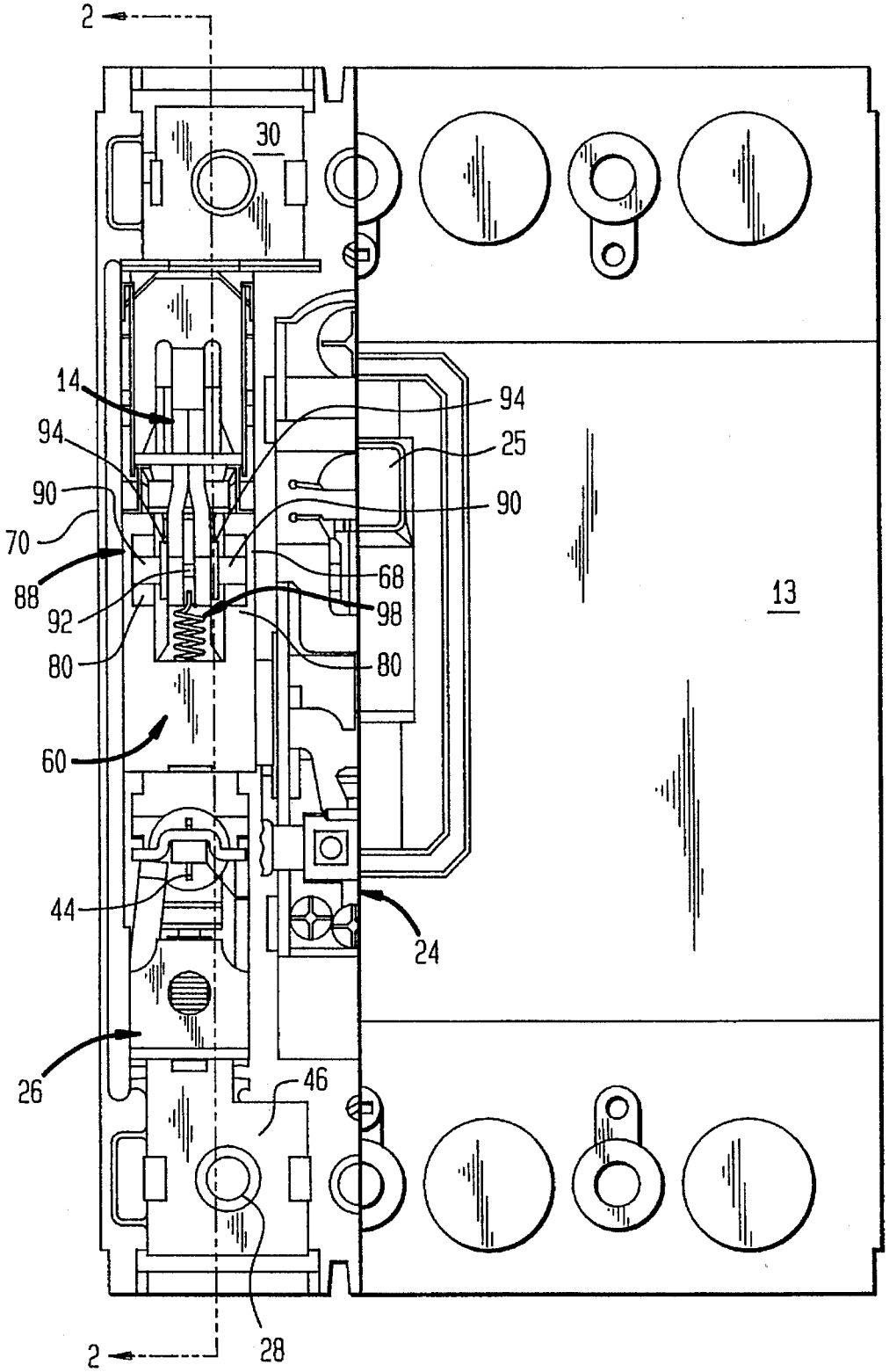
FIG. 2 is a top view of the circuit breaker with a portion of the cover removed to show the components of one phase of the circuit breaker.

Referring to FIGS. 1 and 2, a circuit breaker 10 according to one aspect of the invention includes an insulating plastic support base 12 and cover 13. The main components of circuit breaker 10 are pivoting (movable) upper contact arms 14, pivoting (movable) lower contact arms 16, lower contact arm support spring 18, arc chambers 22, an upper pivoting contact arm operating mechanism 24 (partially shown in FIG. 2), an electronic or thermal magnetic trip unit 26, load terminals 28, and line terminals 30. Circuit breaker 10 is a multi-phase (e.g. three-phase) circuit breaker having one arm 14, one arm 16, support spring 18, terminal 28, and terminal 30 for each of the three phases. Components 16, 18, 22, 24, 26, 28 and 30 are of conventional design, e.g. Siemens Breaker Type HQJ2H. One operating mechanism 24 and one trip unit 26 cooperate to move a single insulative crossbar 32, which moves arms 14 of each phase in unison during contact opening and closing under normal conditions. An operating handle 25 is mechanically coupled to operating mechanism 24 to rotate crossbar 32 between its open and closed positions thereby moving arms 14 between their open and closed positions. For purposes of clarity, the following description will only reference the components of one phase of circuit breaker 10, but it should be understood that it is applicable to each or all of the phases of the circuit breaker.

Contact arm 14 has a conventional electrical contact 34 brazed or otherwise fastened to a first end and a pivot hole 36 at its second end. Electrical contact 34 engages and disengages an electrical contact 38 at the end of contact arm 16. A pivot pin 40, mounted in pivot hole 36 of a pivot clip 37, pivotally attaches contact arm 14 to a terminal strap 42. Pin 40 may also pivotally attach crossbar 32 to base 12 via strap 42. Strap 42 is fastened to base 12 by any suitable means, such as a screw 44, and is coupled to load terminal 28 by trip unit 26. Trip unit 26 is fastened, and electrically connected, to mount 46 of load terminal 28 and mount 48 of strap 42.

Each contact arm 16 is pivotally mounted to base 12 by a pivot pin 17, which pivotally attaches respective arm 16 to a pivot mount 20 which is electrically connected to terminal 30. An arc insulating barrier 56 is attached to base 12 and configured as shown in FIG. 2 to rest between arms 14 and 16 and inhibit arcing therebetween. Insulator 56 is fastened above contact arm 16 with screws 58. More specifically, screws 58 engage threaded holes within base 12. Each contact arm supporting spring 18 is compressed between the respective arm 16 and base 12 to force arm 16 against the bottom surface of insulator 56 as illustrated in FIG. 1.

Load terminals 28 provide locations for electrically coupling a three-phase apparatus or distribution system to circuit breaker 10. Line terminals 30 provide corresponding locations for electrically coupling a three-phase power source to circuit breaker 10. Accordingly, when contacts 34 and 38 for each phase are engaged, power is transmitted from the three-phase power source to the three-phase device or power distribution system. Load and line terminals 28 and 30 may include any suitable attachment means for allowing wires or other conductors to be secured thereto, such as a pair of threaded holes 84 which receive screws for fastening one terminal block (not shown) to each of terminals 28, 30. Of course, depending upon the application, the terminal block may be replaced with other appropriate arrangements for coupling conductors to terminals 28, 30.

In general, operating mechanism 24 moves crossbar 32 between closed and open positions. As discussed in detail below, the configuration of crossbar 32 allows crossbar 32 to interact with arms 14 to move arms 14 between their open and closed positions during ON/OFF switching and under overload conditions. Electrical contacts 34 and 38 are engaged when arms 14 are in their closed positions, and disengaged when arms 14 are in their open positions. When trip unit 26 detects an unacceptable current level (i.e., overload current) in one of the phases, it actuates operating mechanism 24 in a conventional manner so that mechanism 24 rotates crossbar 32 and contact arms 14 counter-clockwise about pin 40 to separate contacts 34 and 38. Occurrence of a fault current in one of the phases will cause the associated contact arm 14 to blow open and pivot counter-clockwise (as viewed in FIG. 1) about pin 40 to separate contacts 34 and 38. At the same time, contact arm 16 rotates clockwise about pin 17 to increase the speed of separation between contacts 34 and 38. However, under these conditions contact arm 14 and 16 will pivot to the open position independent of crossbar 32 while crossbar 32 remains stationary.

Figure 3:
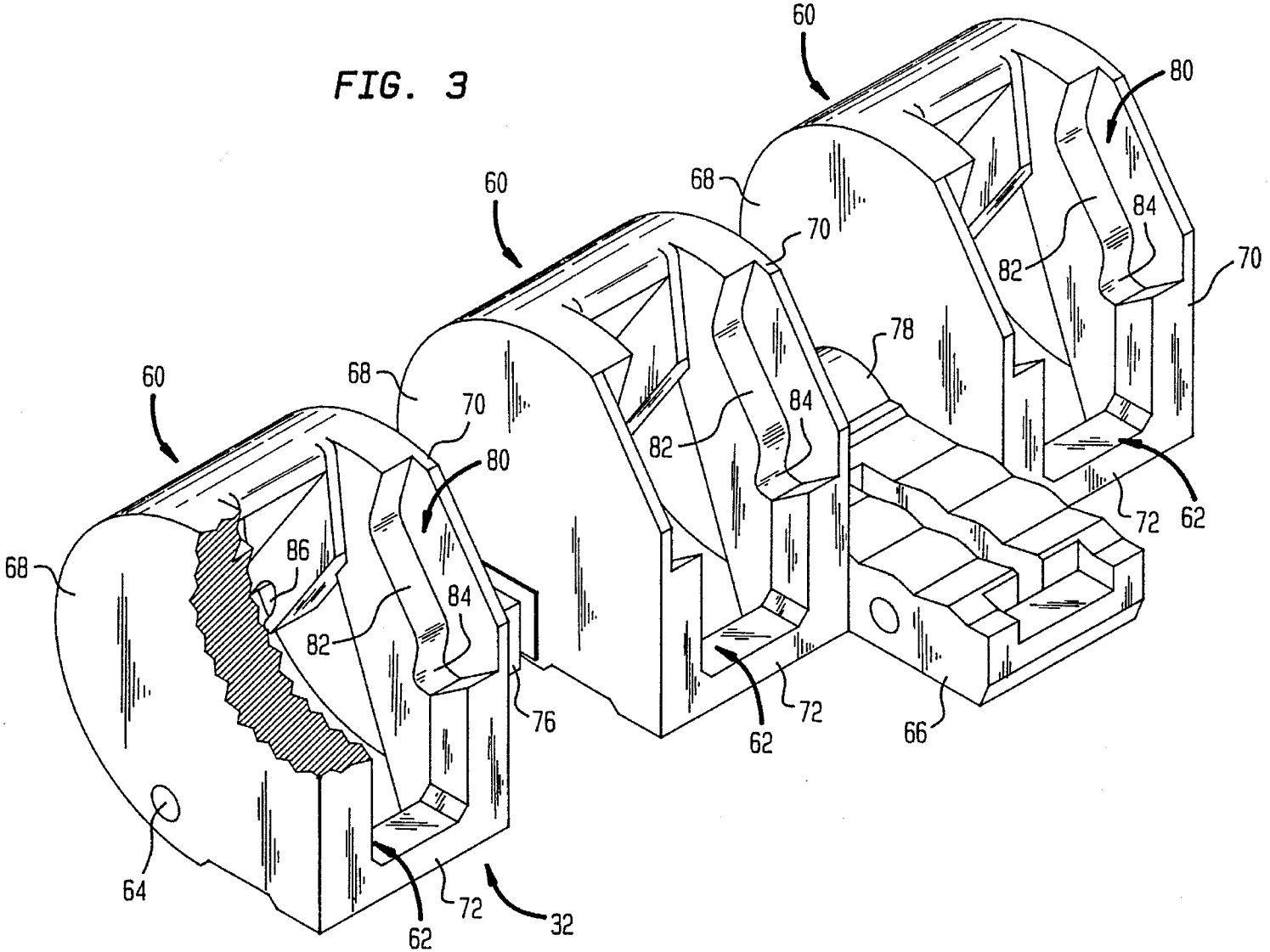
FIG. 3 is a perspective view of the crossbar of the circuit breaker.

Referring to FIG. 3, crossbar 32 is configured as shown and preferably molded from an appropriate thermoset or thermoplastic material (i.e., plastic) having characteristics which do not require the use of reinforcing materials within molded crossbar 32. By way of specific example, the preferred embodiment of crossbar 32 is molded from glass polyester plastic. However, depending upon the application, it may be useful to use strengthening materials such as steel or glass fibers at areas of the crossbar which require additional rigidity and strength, or when an adequate plastic to mold crossbar 32 from is unavailable. The crossbar shown in FIG. 3 is configured for a three-phase circuit breaker and includes three formations 60 each including a saddle 62 within which respective contact arms 14 are located. In general, formations 60 and the associated cam follower (discussed below) connect and disconnect a driving part of circuit breaker 10 (i.e. crossbar 32) with a driven part of circuit breaker 10 (i.e. contact arms 14). In other words, under certain conditions, formation 60 permits arms 14 to move in unison with crossbar 32 or move independently thereof. Thus, formation 60 and the cam follower generally operate as a clutch. Formations 60 of crossbar 32 include pivot holes 64 through which shaft 40 extends. Accordingly, when crossbar 32 is mounted upon pivot shaft 40, crossbar 32 rotates along the axis of shaft 40 which is the same axis of rotation as that of cross arms 14. In addition to formations 60, crossbar 32 also includes an operating arm 66 which is linked to operating mechanism 24. Thus, operating mechanism 24 can rotate crossbar 32 between its open and closed positions.

Each formation 60 includes first and second parallel insulating barriers 68 and 70. Barriers 68 and 70 are joined by a member 72 to form saddles 62 and a member 74 to cooperate with member 72 to provide rigid parallel support between insulating barriers 68 and 70. Adjacent clutches 60 are joined by torque carrying members 76 and 78, which are configured as shown to rigidly attach formations 60 together. As shown in FIG. 3, operating arm 60 is integrally molded with torque member 78.

Each insulating barrier 68 is formed to include a cam surface 80 including two surfaces 82 and 84. Additionally, each insulating barrier 68 and 70 is formed to include a spring pin support slot 86.

Referring again to FIGS. 1 and 2, for each phase of circuit breaker 10 there is included a cam follower 88 having a pair of rollers 90 and a roller shaft or pin 92. Each roller shaft 92 is supported by a respective contact arm 14 by a pair of links 94 attached to respective arm 14. In particular, links 94 are attached to arm 14 by an appropriate rivet, bolt or shaft pin 96. Roller shaft 92 and pin 96 have parallel axes, and pass through appropriately configured openings in links 94. Furthermore, links 94 are fastened to respective arms 14 so that the longitudinal axes of shaft 92 and pin 96 remain generally parallel, and the longitudinal axis of shaft 92 may rotate about the longitudinal axis of pin 96 when cam follower 88 travels along cam surfaces 80.

As discussed above, crossbar 32 is preferably fabricated as a one-piece unit molded from plastic. Accordingly, cam surfaces 80 are also fabricated from plastic. To prevent unacceptable wear which may undesirably restrict the movement of cam follower 88 along cam surface 80, rollers 90 are rotatably mounted on roller shaft 92 to contact surface 80 and roll along surface 80. Use of rollers 90 eliminates the need to slide shaft 92 along surface 80, thus reducing undesirable wearing of plastic surface 80 and increasing the endurance limits.

As discussed above, links 94 of cam follower 88 permit shaft 92 to move along an arc defined by links 94 and pin 96. Accordingly, one end of a spring 98 is attached to shaft 92 and the other end of spring 98 is attached to a spring support pin 100. This arrangement advantageously utilizes a single spring 98 to provide the force to hold rollers 90 of cam follower 88 in contact with cam surface 80. By locating spring 98 between and at substantially equal distances from cam follower rollers 90, rollers 90 are forced against their respective cam surfaces at with substantially equal forces. Additionally, when a respective contact arm 14 is blown open (as discussed in further detail below) and rollers 90 move from surface 84 to surface 82 during unacceptable fault current conditions, spring 98 pulls follower 88 along surface 82 to increase the rotational speed of contact arm 14 in the counter-clockwise direction and thus increase the speed at which contacts 34 and 38 separate. However, under normal operating conditions, spring 98 operates to hold rollers 90 in contact with surface 84 to prevent undesirable counter-clockwise rotation of contact arm 14. Furthermore, spring 98 is mounted in tension to ensure that pin 100 remains in spring pin slots 86, regardless of the position of contact arm 14 relative to crossbar 32.

Turning now to the operation of circuit breaker 10, arm 14 is shown in its closed position, and arm 16 is in its operating position with contacts 34 and 38 being electrically engaged. In its operating position, arm 16 is urged upwardly by an upward force applied by biasing spring 18. When contacts 34 and 38 are engaged, the current path through arms 14 and 16 substantially follows the path shown by the arrow 150. The main component of current in circuit breaker 10 is substantially parallel to the central axis of arm 16 until the current passes from arm 16 to arm 14 via contacts 34 and 38, where the main component of current in arm 14 is substantially parallel to its central axis.

Currents which have current flow components which are parallel and in opposite directions repel each other. This phenomenon is a result of the magnetic fields produced by the currents and the interaction of these magnetic fields with the currents. The magnitude of the repulsion or attraction is affected by the distance between the respective parallel components of the currents, and magnetic shielding which may be provided between the currents. Accordingly, when there is current flow from contact arm 16 to contact arm 14, contact arms 14 and 16 will repel each other due to the repulsive forces ("blow-off forces") produced by the parallel components of current in arms 14 and 16.

When the current flow in arms 14 and 16 is sufficiently high, and hence the blow-off forces are sufficiently high, arms 14 and 16 will be forced to rotate counter-clockwise and clockwise, respectively. During the period in which arms 14 and 16 move in these directions, an arc occurring between contacts 34 and 38 is stretched, extinguished and moved toward arc chamber 22. To move to its blown-open position, arm 14 must be repelled from arm 16 with sufficient force to overcome an opening force required to move cam follower 88 along cam surface 80 from surface 82 to surface 84. The opening force is of opposite magnitude to (i.e., higher than) the moving force produced when follower 88 is pulled along, and to the end of, surface 84. Accordingly, upon moving from surface 82 to 84 the speed of rotation of arm 14 substantially increases to aid in extinguishing the arc. Furthermore, the use of rollers 90 decreases the friction forces developed between follower 88 and surface 84, which further increases the rotational speed of arm 14 during blow apart.

In summary, the present crossbar 32 and follower 88 arrangements make it possible to achieve much higher interrupting ratings and lower let-thru energy in a cost effective manner. Of course, surface 80 could be modified to provide more than the two cam surface configurations 82 and 84.

Subsequent to blow apart, circuit breaker 10 must be reset by rotating the crossbar counter-clockwise to its open (OFF) position. To reset circuit breaker 10, operating mechanism 24 is manually operated in a conventional manner. During reset, a cam follower stop (not shown) engages follower 88 so that follower 88 moves from surface 84 to surface 82 while crossbar 32 is rotated counter-clockwise.

The preferred embodiment of the present invention has been disclosed by way of example and it will be understood that other modifications may occur to those skilled in the art without departing from the scope and spirit of the appended claims. For example, in the present embodiment, rollers 90, shaft 92, links 84 and other similar non-current conducting components of circuit breaker 10 are fabricated from metals. However, improvements in plastic properties may permit replacing these components with similar components fabricated from plastic.

What is claimed is:

1. In a multi-phase circuit breaker of the type including a base, a contact arm associated with each phase and pivotally attached to the base to pivot between open and closed positions to conduct current in the closed position, and an operating mechanism for supplying energy to move the contact arms, a one-piece crossbar comprising:

a first plastic contact arm saddle;

a second plastic contact arm saddle;

a first plastic torque carrying member joined between the saddles and formed integrally with the saddles, the crossbar being pivotably supportable by the base to pivot about a first axis between open and closed positions; and a plastic operating arm including a linking end and joined to the crossbar between the saddles, the plastic operating arm being formed integrally with the saddles and the torque carrying member, and the linking end being offset from the first axis and connectable with the operating mechanism to pivot the crossbar to its open position while the saddles engage the contact arms to thereby move the contact arms to their open positions.

2. The crossbar of claim 1, further comprising pairs of cam surfaces, one pair of cam surfaces molded integrally with each saddle.

3. The crossbar of claim 2, further comprising pairs of parallel insulating barriers each including one of the pair of cam surfaces and molded integrally with the saddles such that the barriers are generally perpendicular to the first axis.

4. The crossbar of claim 3, further comprising glass fibers molded integrally with the plastic.

5. The crossbar of claim 3, wherein each cam surface includes a plurality of surfaces having different radii.

6. The crossbar of claim 3, further comprising:

a third plastic contact arm saddle; and a second plastic torque carrying member joined between the second and third saddles and formed integrally with the saddles.

7. The crossbar of claim 6, further comprising a pair of cam surfaces molded integrally with the third saddle.

8. The crossbar of claim 7, further comprising a pair of parallel insulating barriers each including one of the pair of cam surfaces and molded integrally with the third saddle such that the barriers are generally perpendicular to the first axis.

9. A multi-phase circuit breaker comprising:

a support frame;

a contact operating mechanism supported by the frame;

first and second contact arms supported by the frame to pivot between open and closed positions about a first axis;

a one-piece plastic crossbar supported by the frame to pivot between open and closed positions about a second axis substantially parallel to the first axis, the crossbar including a plastic operating arm integrally formed with the crossbar, extending from the crossbar and including a link end offset from the second axis and mechanically connected to the operating mechanism; and first and second clutches for coupling the crossbar to the first and second contact arms, respectively, such that the contact arms move to their open positions when the crossbar is moved to its open position, and the contact arms are permitted to independently move to their open positions while the crossbar is in its closed position.

10. The circuit breaker of claim 9, further comprising glass fibers molded integrally with the plastic.

11. The circuit breaker of claim 10, wherein each clutch comprises:

a cam follower located on the respective contact arm; and a pair of generally similar cam surface integral with the crossbar, each cam surface including at least a first surface portion which contacts the follower to require a first force to move the follower relative thereto and a second surface portion which contacts the follower to require a second force to move the follower relative thereto, the second force being greater than the first force.

12. The circuit breaker of claim 11, wherein the cam followers are in contact with the second surfaces when the contact arms and the crossbar are in their respective closed positions.

13. The circuit breaker of claim 12, wherein the cam followers includes rollers which contact the cam surfaces and roll along the respective surfaces when the contact arms move to their open positions while the crossbar is in its closed position.

14. The circuit breaker of claim 13, wherein the crossbar further comprises one pairs of plastic barriers located on the respective sides of each contact arm, and each cam surface is formed integrally with one barrier, the barriers being integrally molded with the crossbar.

15. The circuit breaker of claim 14, further comprising one spring connected between each contact arm the crossbar to force the respective cam followers against the respective cam surfaces.

16. The circuit breaker of claim 15, further comprising:

a spring shaft for supporting the cam follower of each contact arm; and a linkage for pivotally attaching the spring shaft to the respective contact arm, the spring being attached to the contact arm by the spring shaft and linkage.

17. The circuit breaker of claim 9, wherein the first and second axes are coincident.

18. The circuit breaker of claim 16 further comprising an operating handle mechanically coupled to the operating mechanism to move the crossbar between its open and closed positions.

19. The crossbar of claim 1 wherein the torque carrying member is configured for resisting elastic twisting between the saddles.

20. The circuit breaker of claim 16 wherein the crossbar is configured such the clutches are offset to compensate for the elastic twisting of the crossbar in the closed position.

* * * * *